US012421651B2

(12) United States Patent
Choi et al.

(10) Patent No.: US 12,421,651 B2
(45) Date of Patent: Sep. 23, 2025

(54) DRYER AND METHOD OF CONTROLLING THE SAME

(71) Applicant: Samsung Electronics Co., Ltd., Suwon-si (KR)

(72) Inventors: Junhoe Choi, Suwon-si (KR); Hoyoung Kim, Suwon-si (KR); Doyoon Kim, Suwon-si (KR); Taegyoon Noh, Suwon-si (KR); Hyejoon Seok, Suwon-si (KR); Jeongsu Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 777 days.

(21) Appl. No.: 17/706,505

(22) Filed: Mar. 28, 2022

(65) Prior Publication Data

US 2022/0220661 A1 Jul. 14, 2022

Related U.S. Application Data

(63) Continuation of application No. PCT/KR2020/095091, filed on Jul. 27, 2020.

(30) Foreign Application Priority Data

Sep. 27, 2019 (KR) ..... 10-2019-0119363

(51) Int. Cl.
*D06F 58/38* (2020.01)
*D06F 58/46* (2020.01)
(Continued)

(52) U.S. Cl.
CPC ..... *D06F 58/38* (2020.02); *D06F 58/46* (2020.02); *D06F 2103/08* (2020.02);
(Continued)

(58) Field of Classification Search
CPC ..... D06F 58/38; D06F 58/46; D06F 2103/08; D06F 2103/24; D06F 2103/32;
(Continued)

(56) References Cited

U.S. PATENT DOCUMENTS 5,291,667 A * 3/1994 Joslin ..... F26B 21/10 34/526
2012/0084997 A1* 4/2012 Bellinger ..... D06F 58/38 34/493
2014/0041249 A1* 2/2014 Jung ..... F26B 23/001 34/282

FOREIGN PATENT DOCUMENTS

CN 106567216 A 4/2017
JP 3022150 B2 3/2000
(Continued)

OTHER PUBLICATIONS

Notice of Preliminary Rejection dated Sep. 20, 2024, in connection with Korean Patent Application No. 10-2019-0119363, 13 pages.
(Continued)

*Primary Examiner* — John P McCormack

(57) ABSTRACT

Provided is a dryer and a method of controlling the same that may determine whether drying is complete based on a temperature difference between a temperature of air discharged to a drum and a temperature of air flowing in from the drum. According to various embodiments, the dryer includes a drum; a heat pump; a duct configured to accommodate an evaporator and a condenser of the heat pump, heat air flowing in from the drum and discharge the air to the drum; a first temperature sensor configured to measure a temperature of the air discharged to the drum; a second temperature sensor configured to measure a temperature of the air flowing in from the drum; and a controller configured to determine that drying is complete, based on maintaining a difference value between the temperature of the air dis-
(Continued)

charged and the temperature of the air flowing in below a preset value.

10 Claims, 7 Drawing Sheets

(51) Int. Cl.
*D06F 103/08* (2020.01)
*D06F 103/24* (2020.01)
*D06F 103/32* (2020.01)
*D06F 105/62* (2020.01)

(52) U.S. Cl.
CPC ..... *D06F 2103/24* (2020.02); *D06F 2103/32* (2020.02); *D06F 2105/62* (2020.02)

(58) Field of Classification Search
CPC .... D06F 2105/62; D06F 58/02; D06F 58/206; D06F 2103/12; D06F 2103/50; D06F 58/26; D06F 2103/10; D06F 2103/38; D06F 2103/52; D06F 2105/12; D06F 2105/56
USPC ..... 34/524
See application file for complete search history.

(56) References Cited

FOREIGN PATENT DOCUMENTS

| | | | | |
|---|---|---|---|---|
| JP | 2012-245112 | A | | 12/2012 |
| JP | 5093204 | B2 | | 12/2012 |
| JP | 2012254207 | A | * | 12/2012 |
| JP | 5934617 | B2 | | 6/2016 |
| JP | 2016220743 | A | * | 12/2016 |
| KR | 10-1992-0020005 | A | | 11/1992 |
| KR | 10-0169005 | B1 | | 1/1999 |
| KR | 10-0587358 | B1 | | 6/2006 |
| KR | 10-0747589 | B1 | | 8/2007 |
| KR | 10-0879768 | B1 | | 1/2009 |
| KR | 10-2012-0065628 | A | | 6/2012 |

OTHER PUBLICATIONS

International Search Report of the International Searching Authority dated Nov. 26, 2020, in connection with International Application No. PCT/KR2020/095091, 6 pages.

* cited by examiner

DRYER AND METHOD OF CONTROLLING THE SAME

CROSS-REFERENCE TO RELATED APPLICATIONS

This application is a Bypass Continuation of International Application No. PCT/KR2020/095091, filed Jul. 27, 2020, which claims priority to Korean Patent Application No. 10-2019-0119363, filed Sep. 27, 2019, the disclosures of which are herein incorporated by reference in their entirety.

BACKGROUND

1. Field

The disclosure relates to a dryer that dries laundry such as clothes and determines the completion of drying.

2. Description of Related Art

A dryer is a device for drying laundry such as garments, towels, bedclothes, etc., by supplying hot air into its drum containing the laundry while rotating the drum.

A drying course for the laundry may be performed for a period of time set in advance, determined depending on original weight of the laundry, or initially selected by a user.

However, when the drying time is fixed as described above, the drying process proceeds regardless of an actual degree of dryness of the laundry, so the drying course continues unnecessarily even after the laundry is already dried out, or finished even when the laundry is not dried yet.

Accordingly, a technology of determining when to complete a drying course by measuring a degree of dryness of laundry during the drying course has recently been developed, but the technology is still less accurate in measuring the degree of dryness.

SUMMARY

It is an aspect of the disclosure to provide a dryer and a method of controlling the same that may determine whether drying is complete based on a temperature difference between a temperature of air discharged to a drum and a temperature of air flowing in from the drum.

According to various embodiments of the disclosure, there is provided a dryer, including; a drum; a heat pump; a duct configured to accommodate an evaporator and a condenser of the heat pump, heat air flowing in from the drum and discharge the air to the drum; a first temperature sensor configured to measure a temperature of the air discharged to the drum; a second temperature sensor configured to measure a temperature of the air flowing in from the drum; and a controller configured to determine that drying is complete, based on maintaining a difference value between the temperature of the air discharged and the temperature of the air flowing in below a preset value.

The controller is configured to determine that the difference value is maintained below the preset value based on determining that the difference value is less than the preset value and a number of times, which an amount of change with time is less than a preset amount, is greater than or equal to a preset number of times.

When determining the difference value, the controller is further configured to determine an amount of change with time of the difference value as an amount of change between the difference value and a minimum value among previously determined difference values.

The controller is further configured to repeatedly determine a difference value for every first time period, and, for each first time period, determine a difference value between a mean value of the temperature of the air discharged during the first time period and a mean value of the temperature of the air flowing in during the first time period, as a difference value for a corresponding first time period.

When a revolution per minute (RPM) of a compressor of the heat pump is changed, the controller is further configured to determine whether drying is complete based on a difference value determined after a preset period of time based on a change time of the RPM.

The dryer further includes a heater provided in the duct and configured to heat the air discharged.

The controller is further configured to determine whether drying is complete, based on a difference value determined after the heater is turned off.

The dryer further includes an electrode sensor configured to measure whether laundry accommodated in the drum is in contact in a wet state.

The controller is further configured to determine that drying is complete after a period of time corresponding to a preset ratio to a period of time of a drying process performed, based on a determination that the laundry is not in contact for a preset period of time based on an output value of the electrode sensor.

The controller is further configured to determine that drying is complete after a preset period of time has elapsed from a start of a drying process.

According to various embodiments of the disclosure, there is provided a method of controlling a dryer including a drum, a heat pump, a duct configured to accommodate an evaporator and a condenser of the heat pump, and heat air flowing in from the drum to discharge the air to the drum, a first temperature sensor configured to measure a temperature of the air discharged to the drum, and a second temperature sensor configured to measure a temperature of the air flowing in the duct from the drum, the method including: determining that drying is complete, based on maintaining a difference value between the temperature of the air discharged and the temperature of the air flowing in below a preset value.

The determining that drying is complete includes determining that the difference value is maintained below the preset value based on determining that the difference value is less than the preset value and a number of times that an amount of change with time is less than a preset amount is greater than or equal to a preset number of times.

When determining the difference value, the determining that drying is complete includes determining an amount of change with time of the difference value as an amount of change between the difference value and a minimum value among previously determined difference values.

When repeatedly determining the difference value every first time period, the determining that drying is complete includes determining a difference value between a mean value of the temperature of the air discharged during the first time period and a mean value of the temperature of the air flowing in during the first time period, as a difference value for a corresponding first time period.

The method of controlling a dryer further includes, when a RPM of a compressor of the heat pump is changed, determining whether drying is complete, based on a difference value determined after a preset period of time based on a change time of the RPM.

The dryer and the method of controlling the same according to an aspect of the disclosure can determine whether drying is complete based on a temperature difference between a temperature of air discharged to a drum and a temperature of air flowing in from the drum, thereby can improve an accuracy of controlling a drying end point.

DETAILED DESCRIPTION

Figure 1:
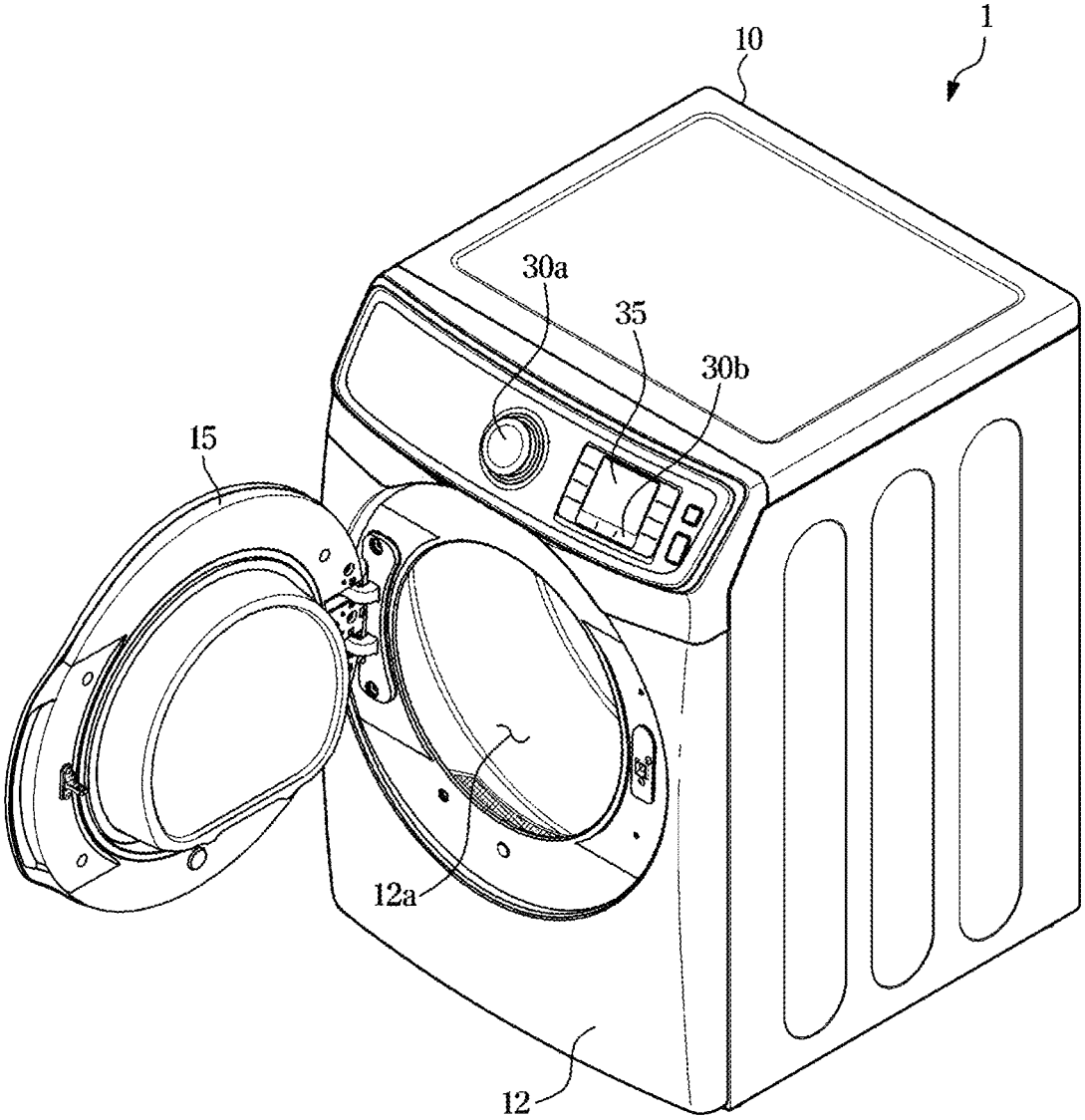
FIG. 1 illustrates an exterior view of a dryer according to various embodiments of the disclosure.
Figure 2:
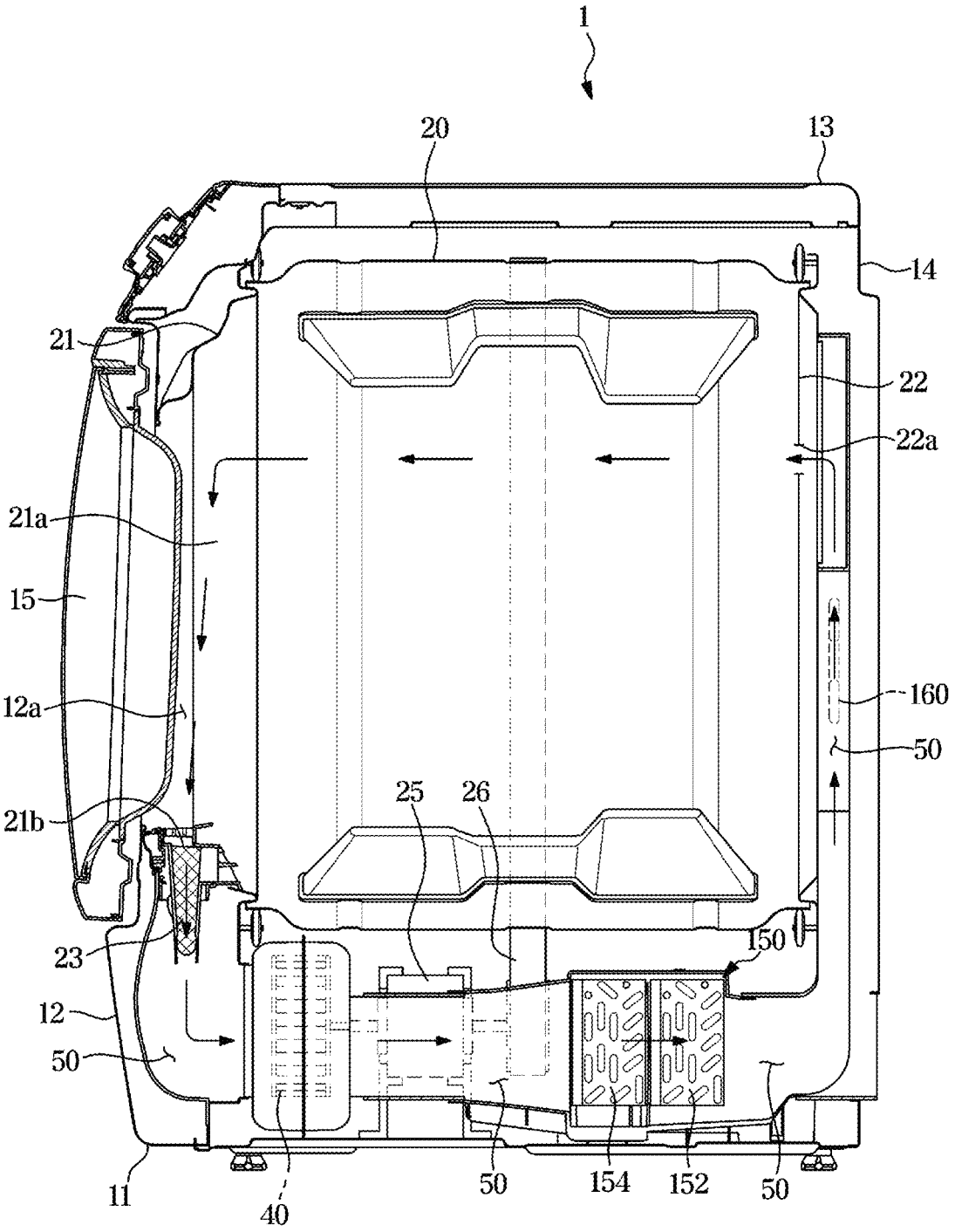
FIG. 2 illustrates a side cross-sectional view of a dryer according to various embodiments of the disclosure.

FIG. 1 illustrates an exterior view of a dryer according to various embodiments of the disclosure. FIG. 2 illustrates a side cross-sectional view of a dryer according to various embodiments of the disclosure.

Referring to both FIGS. 1 and 2, a dryer 1 according to certain embodiments includes a main body 10 defining an exterior of the dryer 1, and a drum 20 installed rotationally in the main body 10 to accommodate laundry.

The main body 10 may include a base plate 11, a front cover 12, a top cover 13 and a side and rear cover 14.

An opening 12*a* is formed on the front cover 12, and is open and closed by a door 15 installed pivotally on the front cover 12. The drum 20 having a form of a cylinder with an open front may also be open and closed by the door 15.

On the top of the front cover 12, inputs 30*a* and 30*b* for receiving control commands from a user and a display 35 for displaying a screen to present various information about operations of the dryer 1 or guide user inputs, may be disposed.

The inputs 30*a* and 30*b* may be provided as a jog shuttle or in a form of dial, allowing the user to hold and turn the input 30*a* to enter a control command, or may be provided as a touch pad or buttons, allowing the user to touch or press the input 30*b* to enter a control command.

The display 35 may be implemented by various types of display panel, such as liquid crystal display (LCD) panel, a light emitting diode (LED) panel, an organic LED (OLED) panel, a quantum LED (QLED) panel, and the like, and also implemented as a touch screen having a touch pad on the front.

A front panel 21 having an entrance 21*a* formed on the front may be arranged on the front of the drum 20, and the laundry may be thrown into the drum 20 through the entrance 21*a*. The rear of the drum 20 may be blocked by a rear panel 22 with an outlet 22*a* through which hot and dry air flows out.

An outlet 21*b* through which the air used in drying of the laundry flows out may be formed on the front panel 21 of the drum 20, and a filter 23 may be installed at the outlet 21*b* to capture foreign materials from the laundry.

That is, the air discharged to the drum 20 through the outlet 22*a* is used for drying the laundry, and then may be entered into the duct 50 from the drum 20 through the outlet 21*b*. The air used in drying the laundry may be converted into hot dry air through a heat pump 150 after entering into the duct 50, and be discharged again to the drum 20 through the outlet 22*a*.

Also, at least one protruding lifter may be formed on an inner wall of the drum 20 to assist in tumbling of the laundry.

The drum 20 may be rotated by driving force provided from a drum motor 25. The drum 20 may be connected to the drum motor 25 by a belt 26, and the belt 26 may convey the driving force provided from the drum motor 25 to the drum 20.

The dryer 1 may include a fan 40 for circulating air in the drum 20. The fan 40 may suck in air from the inside of the drum 20 and discharge the air to a duct 50. The air inside the drum 20 may be circulated by the fan 40 between the drum 20 and the duct 50.

The heat pump 150 may be equipped in the duct 50 in which the air from inside the drum 20 circulates. The heat pump 150 may include a compressor (not shown), a condenser 152, an evaporator 154 and an expander (not shown).

The compressor may compress a gaseous refrigerant into a hot and highly compressed state and discharge the hot and highly compressed gaseous refrigerant. For example, the compressor may compress the refrigerant by reciprocating motions of a piston or rotating motions of a rotor. The discharged refrigerant is passed to the condenser 152.

The condenser 152 may radiate heat while condensing the compressed gaseous refrigerant into a liquid state. The condenser 152 may be provided in the duct 50 to heat air by the heat radiated in the process of condensing the refrigerant. The heated air may be supplied into the drum 20. The liquid refrigerant condensed by the condenser 152 may be passed to the expander (not shown).

The expander may expand the high temperature and high pressure liquid refrigerant condensed by the condenser 152 to a low pressure liquid refrigerant. Specifically, the expander may include an electronic expansion valve whose opening degree is variable by a capillary tube and an electric signal for controlling the pressure of the liquid refrigerant.

The evaporator 154 may evaporate the liquid refrigerant expanded by the expander. As a result, the evaporator 154 may return the low temperature and low pressure gaseous refrigerant to the compressor.

The evaporator 154 may absorb heat from the surroundings during an evaporation process for turning the low pressure liquid refrigerant to the gaseous refrigerant. The evaporator 154 may be provided in the duct 50 to cool the air that is passing the evaporator 154 during the evaporation process. When the surrounding air is cooled down by the evaporator 154 and has a temperature fallen below the dew point, the air around the evaporator 154 may be condensed. Water resulting from the air condensation in the evaporator 154 may be collected by a water tray arranged under the evaporator 154. The water collected by the water tray may be moved to a separate reservoir or discharged out of the dryer 1.

Due to the condensation occurring around the evaporator 154, absolute humidity of the air that is passing the evaporator 154 may be reduced. That is, the amount of water vapor contained in the air passing the evaporator 154 may be reduced. Using the condensation around the evaporator 154, the dryer 1 may reduce the amount of water vapor contained in the air in the drum 20 and dry the laundry.

The evaporator 154 may be disposed in farther upstream of airflow from the fan 40 than the condenser 152. The air circulating by the fan 40 may be dried out (i.e., water vapor is condensed) by the evaporator 154 while passing the evaporator 154, and then heated by the condenser 152 while later passing the condenser 152.

In the meantime, a heater 160 may be provided in the duct 50 to assist the condenser 152 in heating the air. The heater 160 may be disposed in farther downstream of airflow from the fan 40 than the condenser 152.

For example, the air in the duct 50 may be sufficiently heated when the heater 160 additionally heats the air that has already been heated by the condenser 152 of the heat pump 150.

The temperature in the drum 20 may rise more rapidly by the heater 160 that assists the condenser 152, thereby may reduce the time taken to dry the laundry.

Figure 3:
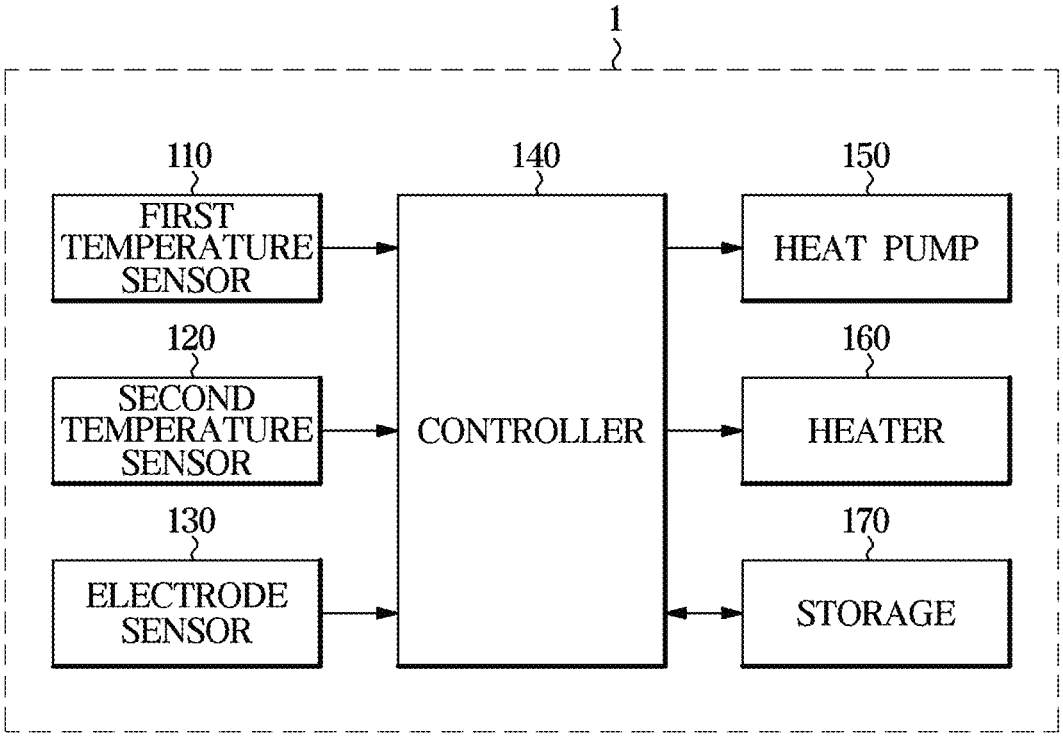
FIG. 3 illustrates a control block diagram of a dryer according to various embodiments of the disclosure.

FIG. 3 illustrates a control block diagram of the dryer 1 according to various embodiments of the disclosure.

Referring to FIG. 3, according to certain embodiments, the dryer 1 may include a first temperature sensor 110, a second temperature sensor 120, an electrode sensor 130, a controller 140, the heat pump 150, the heater 160 and a storage 170. The first temperature sensor 110 measures a temperature of air discharged to the drum 20 from the duct 50. The second temperature sensor 120 measures a temperature of air flowing into the duct 50 from the drum 20. The electrode sensor 130 measures whether laundry accommodated in the drum 20 is in contact in a wet state. The controller 140 determines whether drying is complete based on output values of the sensors 110, 120 and 130. The heat pump 150 and the heater 160 heat the air flowing into the duct 50. The storage 170 stores various information required for controlling the dryer 1.

According to embodiments, however, the dryer 1 may not include the electrode sensor 130 or the heater 160.

According to certain embodiments, the first temperature sensor 110 may measure the temperature of air discharged to the drum 20 from the duct 50. That is, the first temperature sensor 110 may measure the temperature of hot and dry air supplied to the drum 20.

To this end, the first temperature sensor 110 may be provided in the duct 50. Specifically, the first temperature sensor 110 may be provided between the condenser 152 and the outlet 22*a*.

Also, according to embodiments, the first temperature sensor 110 may be provided in the heater 160 and correspond to a sensor for measuring a temperature of the heater 160. When the heater 160 is turned on, an output value of the first temperature sensor 110 may correspond to the temperature of the heater 160, and when the heater 160 is turned off, the output value of the first temperature sensor 110 may correspond to the temperature of air discharged to the drum 20 from the duct 50.

According to certain embodiments, the second temperature sensor 120 may measure the temperature of the air flowing into the duct 50 from the drum 20. That is, the second temperature sensor 120 may measure the temperature of the air flowing into the duct 50 from the drum 20 after use for drying laundry.

To this end, the second temperature sensor 120 may be provided in the duct 50, specifically, provided between the outlet 21*b* and the evaporator 154 of the heat pump 150.

A type of the temperature sensors 110 and 120 is not limited as long as they are a sensor capable of measuring a temperature.

According to certain embodiments, the electrode sensor 130 may measure whether the laundry accommodated in the drum 20 is in contact in a wet state.

The electrode sensor 130 may include two electrodes spaced apart from each other by a predetermined distance. In this instance, when the laundry in a wet state is in contact with the two electrodes, the electrode sensor 130 may output current as the two electrodes are short-circuited through the laundry.

That is, when wet laundry is in contact, the electrode sensor 130 may output current, and when dry laundry is in contact or no laundry is in contact, the electrode sensor 130 does not output current. Through the above, the electrode sensor 130 may measure whether the laundry accommodated in the drum 20 is in contact in a wet state.

To this end, the electrode sensor 130 may be provided in the front panel 21 of the drum 20. According to embodiments, the electrode sensor 130 may be provided on the drum 20 side of the door 15.

According to certain embodiments, the controller 140 may determine whether drying is complete based on the output value of the first temperature sensor 110 and the output value of the second temperature sensor 120. That is, when a drying process is performed, the controller 140 may determine an end of the drying process based on the output value of the first temperature sensor 110 and the output value of the second temperature sensor 120.

Specifically, based on maintaining a difference value between the output value of the first temperature sensor 110 and the output value of the second temperature sensor 120 below a preset value, the controller 140 may determine that drying is complete.

That is, based on maintaining a difference value between the temperature of the air discharged to the drum 20 and the temperature of the air flowing into the duct 50 from the drum 20 below the preset value, the controller 140 may determine that drying is complete.

The controller 140 may determine that the difference value is maintained below the preset value, based on determining that the difference value is less than the preset value and the number of times that the amount of change with time is less than a preset amount is greater than or equal to a preset number of times.

The air discharged to the drum 20 corresponds to hot and dry air, and evaporation heat may be provided to the laundry as the hot and dry air is used to dry the laundry. Accordingly, the air used for drying the laundry may have a lower temperature and higher humidity than the air discharged to the drum 20.

As a result, as drying is progressed, evaporation heat provided to the laundry by the air discharged to the drum 20 may be reduced, and a temperature difference between the temperature of the air discharged to the drum 20 and the temperature of the air flowing into the duct 50 from the drum 20 may also be decreased.

That is, based on determining that the temperature difference between the temperature of the air discharged to the drum 20 and the temperature of the air flowing in from the drum 20 is less than the preset value and a change in temperature difference remains small, the controller 140 may determine that the temperature difference between the temperature of the air discharged to the drum 20 and the temperature of the air flowing in from the drum 20 converges, thereby may determine that drying is complete.

In this instance, according to embodiments, the controller 140 may determine the difference value at preset time intervals, and when determining a difference value at a specific point in time, may determine the amount of change between the difference value at the specific point in time and a minimum value among difference values determined before the specific point in time, as the amount of change with time of the difference value at the specific point in time.

That is, the controller 140 may compare a minimum value among previously determined temperature difference values with a current temperature difference value to determine whether the temperature difference changes, and thus an influence of temperature increase due to external conditions may be excluded.

Also, according to embodiments, when determining a difference value ($\Delta T$) at preset time intervals, the controller 140 may determine a difference value between a mean value of the temperature of the air discharged during the preset time and a mean value of the temperature of the air flowing in during the preset time, as a difference value in a corresponding time.

Specifically, when repeatedly determining a difference value at intervals of a first time period (e.g., 30 seconds), the controller 140 may determine a difference value between a mean value of the temperature of the air discharged to the drum 20 during the first time period and a mean value of the temperature of the air flowing into the duct 50 from the drum 20 during the first time period, as a difference value in a corresponding time.

In addition, according to embodiments, when a revolution per minute (RPM) of a compressor of the heat pump 150 is changed, the controller 140 may determine a difference value between the temperature of the air discharged to the drum 20 and the temperature of the air flowing into the duct 50 from the drum 20, after a preset period of time from a change time of the RPM.

The temperature of the air discharged to the drum 20 may change rapidly due to the change in RPM of the heat pump 150, and the temperature of the air flowing into the duct 50 from the drum 20 may also be affected.

Therefore, according to the change in RPM of the heat pump 150, a change in difference value between the temperature of the air discharged to the drum 20 and the temperature of the air flowing into the duct 50 from the drum 20 may occur.

Accordingly, in order to determine a valid difference value, the controller 140 may not determine the difference value for a predetermined period of time from a change time of the RPM of the heat pump 150, and may determine the difference value at preset time intervals after the predetermined period of time.

Also, according to embodiments, when a control of the heater 160 is performed, the controller 140 may determine the difference value after the heater 160 is turned off, in order to determine a valid difference value for the same reason as the change of RPM of the heat pump 150. Determination on whether drying is complete based on the output value of the first temperature sensor 110 and the output value of the second temperature sensor 120 is described in detail later.

According to certain embodiments, the controller 140 may determine whether drying is complete based on an output value of the electrode sensor 130.

Specifically, based on the output value of the electrode sensor 130 not existing for a predetermined period of time, i.e., based on wet laundry not contacting the electrode sensor 130 for the predetermined period of time, the controller 140 may determine that drying is complete after a period of time corresponding to a preset ratio to a period of time of a drying process performed.

That is, the controller 140 may control the dryer 1 to additionally perform the drying process for the period of time corresponding to the preset ratio to the period of time of the drying process performed, from a point in time when it is determined that an electrode detection by the electrode sensor 130 is finished due to no contact with wet laundry. Afterwards, the controller 140 may determine that drying is complete and may end the drying process.

In addition, according to certain embodiments, the controller 140 may determine that drying is complete after a preset period of time from a start of the drying process. In this instance, the preset period of time may set differently depending on a course of the drying process, and set by a user through the inputs 30*a* and 30*b*.

The controller 140 may include at least one memory storing a program for performing the aforementioned operations and operations to be described below, and at least one processor implementing a stored program.

The controller 140 may control overall operations of the dryer 1 as well as determine a drying end point. The drying process may include operations of the heat pump 150 and rotation of the drum 20. Additionally, the drying process may include operations of the heater 160. By the operation of the heater 160, moisture inside the drum 20 may be removed and high-temperature air may be supplied into the drum 20. By the rotations of the drum 20, the laundry tumbles, and thus the laundry may be heated and moisture removed more efficiently.

Accordingly, the controller 140 may control the heat pump 150 and the drum 20 to perform the drying process. For example, the controller 140 may transmit a control signal to a motor driver (not shown) that drives a drum motor 25 for rotating the drum 20 and a fan motor for rotating the fan 40 to control the rotations of the drum 20 and the fan 40. The motor driver may include a motor driving circuit (not shown).

In addition, the controller 140 may transmit a control signal to the heat pump 150 to remove moisture inside the drum 20 and supply hot air. As described above, when the heater 160 is disposed in the duct 50, the controller 140 may transmit a control signal to the heater 160 to increase a temperature of hot air supplied to the drum 20.

According to certain embodiments, the heat pump 150 may heat the air flowing into the duct 50 from the drum 20 under the control of the controller 140, so that the duct 50 heats the air flowing in from the drum 20 and discharge the heated air to the drum 20. To this end, the duct 50 may accommodate the condenser 152 and the evaporator 154 of the heat pump 150.

In this instance, the heat pump 150 may change a RPM based on at least one of the temperature of the air discharged to the drum 20 or the temperature of the air flowing into the duct 50 from the drum 20, under the control of the controller 140.

For instance, based on the temperature of the air discharged to the drum 20 decreasing, the heat pump 150 may increase the RPM, thereby may increase the temperature of the air discharged to the drum 20. Also, based on the temperature of the air discharged to the drum 20 increasing, the heat pump 150 may decrease the RPM, thereby may decrease the temperature of the air discharged to the drum 20. That is, the heat pump 150 changes the RPM under the control of the controller 140, thereby may maintain the temperature of the air discharged to the drum 20 at a target temperature.

According to certain embodiments, the heater 160 may assist the condenser 152 to heat the air passing through the duct 50.

Specifically, when the drying process starts, the heater 160 may be turned on until the temperature of the air discharged to the drum 20 reaches a preset temperature, under the control of the controller 140. Afterwards, the heater 160 may be turned off and the air discharged to the drum 20 may be heated by the heat pump 150.

According to certain embodiments, the storage 170 may store various information required for controlling the dryer 1. For example, the storage 170 may store a reference value used to compare the temperature difference value for determining a drying end point.

The storage 170 may be implemented with non-volatile memory such as cache, read only memory (ROM), programmable read only memory (PROM), erasable programmable read only memory (EPROM), electrically erasable programmable read only memory (EEPROM) and flash memory, or a volatile memory such as random access memory (RAM) or storage medium such as hard disk drive (HDD) and compact disc read only memory (CD-ROM), without being limited thereto.

Each constituent component of the dryer 1 has been described in detail above. Hereinafter, the dryer 1 determining a drying end point based on an output value of the first temperature sensor 110 and an output value of the second temperature sensor 120 is described in detail.

Figure 4:
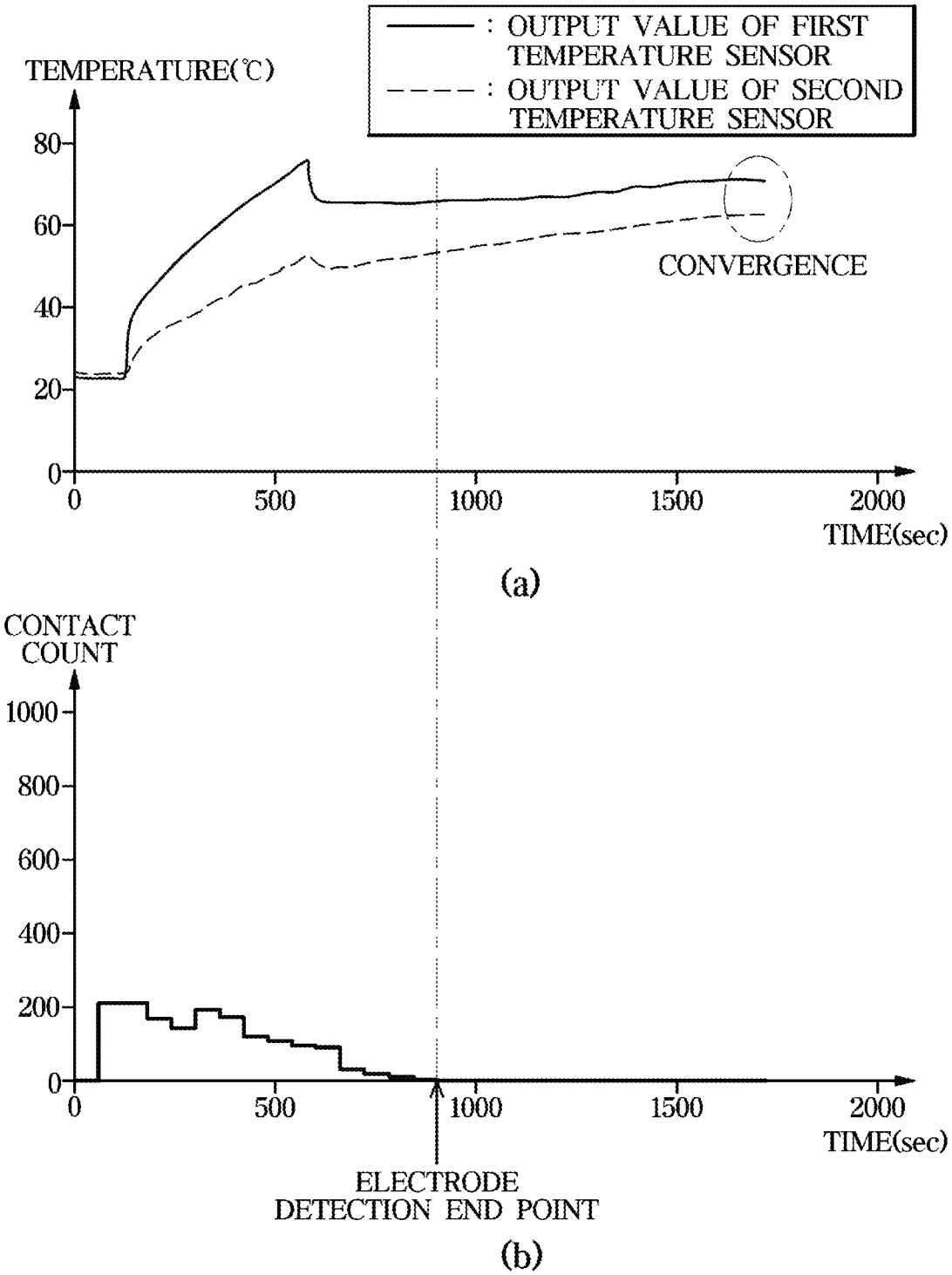
FIG. 4 illustrates graphs showing outputs of a first temperature sensor, a second temperature sensor and an electrode sensor of a dryer according to various embodiments of the disclosure.

FIG. 4 illustrates graphs showing outputs of the first temperature sensor 110, the second temperature sensor 120 and the electrode sensor 130 of the dryer 1 according to various embodiments of the disclosure.

Referring to FIG. 4, it may be confirmed that a difference between an output value of the first temperature sensor 110 and an output value of the second temperature sensor 120 decreases over time, as shown in FIG. 4A.

Specifically, the dryer 1 may start the drying process based on a user input through the inputs 30*a* and 30*b*. After the start of the drying process, a difference between a temperature represented by the output value of the first temperature sensor 110 and a temperature represented by the output value of the second temperature sensor 120 may decrease over time.

That is, the difference between the output value of the first temperature sensor 110 and the output value of the second temperature sensor 120 is great at a beginning of the drying process, and then as drying is progressed, the difference gradually decreases through heat exchange due to drying of laundry, and may eventually converge to the same value or a constant difference value.

Air discharged to the drum 20 corresponds to hot and dry air, and evaporation heat may be provided to the laundry as the hot and dry air is used to dry the laundry. Accordingly, the air used for drying the laundry may have a lower temperature and higher humidity than the air discharged to the drum 20.

As a result, as drying is progressed, evaporation heat provided to the laundry by the air discharged to the drum 20 may be reduced, and a temperature difference between a temperature of the air discharged to the drum 20 and a temperature of air flowing into the duct 50 from the drum 20 may also be decreased.

That is, when drying is complete, a temperature difference between the temperature of the air discharged to the drum 20 and the temperature of the air flowing into the duct 50 from the drum 20 may converge to 0 or to a low value.

Accordingly, the dryer 1 of the disclosure may determine a drying end point based on the temperature difference.

As shown in FIG. 4B, as drying is progressed, a contact count of the laundry in a wet state to the electrode sensor 130 may decrease and converge to 0. Here, the contact count is measured by the electrode sensor 130.

In this instance, when a point at which an output of the electrode sensor 130 converges to 0, i.e., a point at which an electrode detection ends, is determined as a drying end point, the contact to the electrode sensor 130 is not smoothly made under minimal load due to a small amount of laundry in the drum 20, and thus drying may not be actually completed.

Comparing FIGS. 4A and 4B, it may be confirmed that even after the contact count to the electrode sensor 130 converges to 0, the temperature difference between the temperature of the air discharged to the drum 20 and the temperature of the air flowing into the duct 50 from the drum 20 is reduced due to evaporation heat supplied to the laundry.

Accordingly, determining the drying end point based on the temperature difference between the temperature of the air discharged to the drum 20 and the temperature of the air flowing into the duct 50 from the drum 20 may improve an accuracy, compared to determining the drying end point through the electrode sensor 130.

Thus, the controller 140 of the dryer 1 may determine whether drying is complete based on the output value of the first temperature sensor 110 and the output value of the second temperature sensor 120. That is, when the drying process is performed, the controller 140 may determine an end of the drying process based on the output value of the first temperature sensor 110 and the output value of the second temperature sensor 120.

Specifically, the controller 140 may determine that drying is complete, based on maintaining a difference value between the output value of the first temperature sensor 110 and the output value of the second temperature sensor 120 below a preset value (e.g., 7° C. or 9° C.).

That is, the controller 140 may determine that drying is complete, based on maintaining a difference value between the temperature of the air discharged to the drum 20 and the temperature of the air flowing into the duct 50 from the drum 20 below a preset value.

In this instance, the controller 140 may determine that the difference value is maintained below the preset value, based on determining that the difference value is less than the preset value and a number of times, which the amount of change with time is less than a preset amount, is greater than or equal to a preset number of times.

Specifically, the controller 140 may determine the difference value ($\Delta T = T_1 - T_2$) between the temperature ($T_1$) of the air discharged to the drum 20 and the temperature ($T_2$) of the air flowing into the duct 50 from the drum 20 at preset time intervals. Also, every time the difference value ($\Delta T$) is determined, the controller 140 may determine whether a corresponding difference value ($\Delta T$) is less than the preset value. Based on the determination that the corresponding difference value ($\Delta T$) is below the preset value, the controller 140 may determine whether the amount of change ($|\Delta T-\Delta T_{min}|$) between the corresponding difference value ($\Delta T$) and a minimum value ($\Delta T_{min}$) among previously determined difference values is less than a preset amount (e.g., 0.08). In this instance, based on determining that the amount of change between the corresponding difference value ($\Delta T$) and the minimum value ($\Delta T_{min}$) among the previously determined difference values is less than the preset amount, the controller 140 may add 1 to a count variable.

Based on determining that the count variable is greater than or equal to a preset number of times (e.g., 10 or 30), the controller 140 may determine that the difference value ($\Delta T$) is maintained below the preset value. Accordingly, the controller 140 may determine that drying is complete and end the drying process.

In this instance, the preset number of times may be set differently depending on the preset value that is compared with the difference value ($\Delta T$). Specifically, the preset number of times may be set higher as the preset value that is compared with the difference value ($\Delta T$) increases.

As described above, according to certain embodiments, the dryer 1 may consider the number of times that the difference value ($\Delta T$) is less than the preset value, and further consider whether the amount of change ($|\Delta T-\Delta T_{min}|$) between the corresponding difference value ($\Delta T$) and the minimum value ($\Delta T_{min}$) among the previously determined difference values is less than the preset amount (e.g., 0.08), in order to determine whether the amount of change with time remains small, i.e., whether the difference value ($\Delta T$) converges, for determining whether the difference value ($\Delta T$) is maintained below the preset value.

Through the above, according to certain embodiments, the dryer 1 may prevent an erroneous determination that drying is complete even though drying is not complete, as the difference value ($\Delta T$) temporarily decreases below the preset value due to external noise.

Also, according to certain embodiments, in determining the amount of change with time of the difference value ($\Delta T$), the dryer 1 may compare the minimum value ($\Delta T_{min}$) among the previously determined difference values with a current difference value ($\Delta T$) to determine the amount of change ($|\Delta T-\Delta T_{min}|$), and thus an influence of temperature increase due to external noise may be excluded.

That is, the dryer 1 may determine whether the difference value ($\Delta T$) is converging based on the minimum value ($\Delta T_{min}$) by setting the minimum value ($\Delta T_{min}$) among the previously determined difference values as a comparison target of the amount of the change, and thus an accuracy of determining completion of drying may be improved.

Also, according to embodiments, when determining the difference value ($\Delta T$) at preset time intervals, the controller 140 may determine a difference value between a mean value of the temperature of the air discharged during the preset time and a mean value of the temperature of the air flowing in during the preset time, as the difference value ($\Delta T$) in a corresponding time.

For example, when repeatedly determining a difference value at intervals of a first time period (e.g., 30 seconds), the controller 140 may determine a difference value ($T_{1_mean}-T_{2_mean}$) between a mean value ($T_{1_mean}$) of the temperature of the air discharged during the first time period and a mean value ($T_{2_mean}$) of the temperature of the air flowing in during the first time period, as the difference value ($\Delta T$) in the corresponding time.

As described above, according to certain embodiments, the dryer 1 may determine whether drying is complete based on the difference value ($\Delta T$) between the output value of the first temperature sensor 110 and the output value of the second temperature sensor 120.

However, the difference value ($\Delta T$) may be affected by operations of the heat pump 150 or the heater 160. Accordingly, hereinafter, determining a valid difference value ($\Delta T$) is described.

Figure 5:
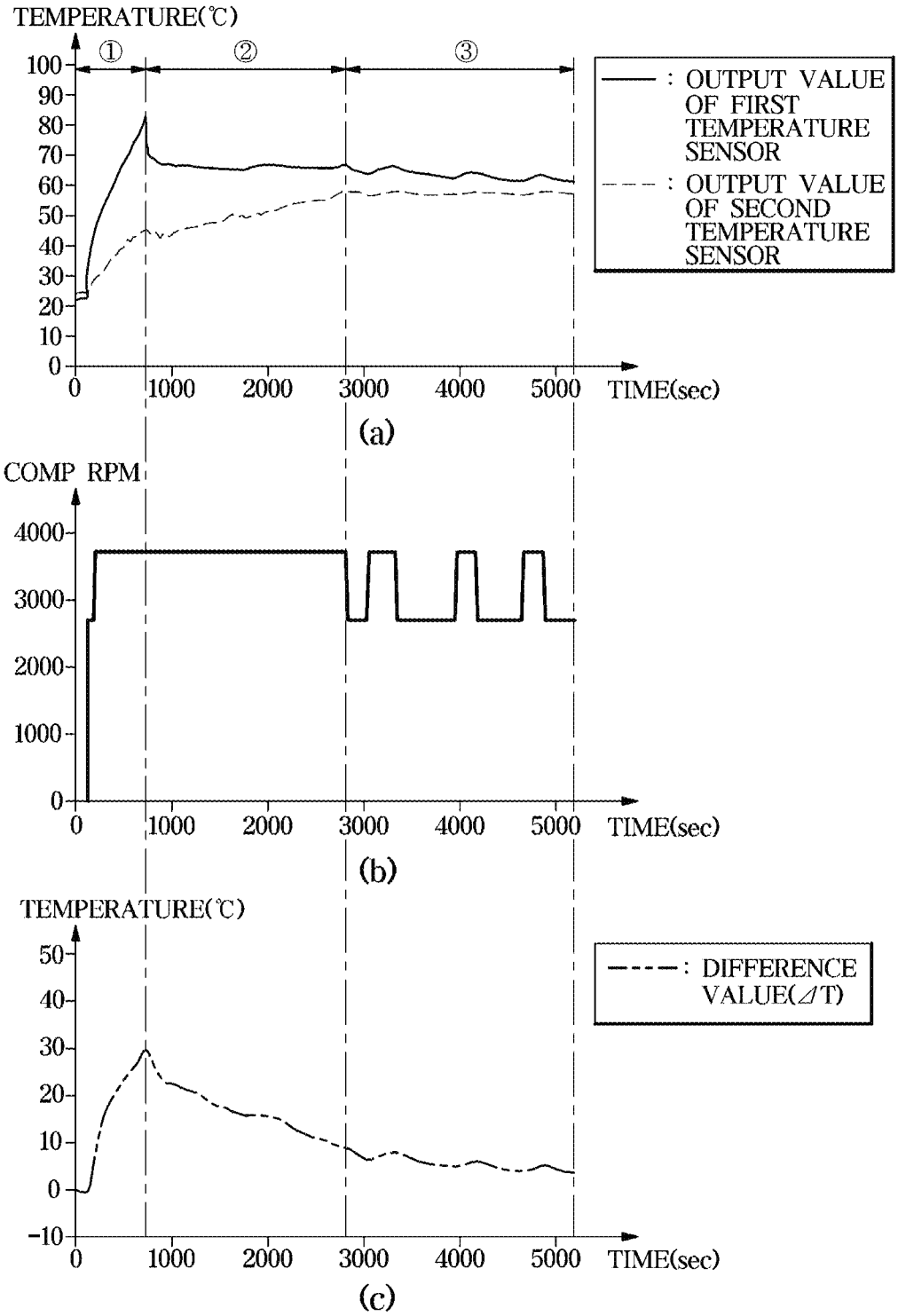
FIG. 5 illustrates diagrams for describing that a dryer according to various embodiments of the disclosure determines a valid difference value.

FIG. 5 illustrates diagrams for describing that the dryer 1 according to various embodiments of the disclosure determines a valid difference value.

Referring to FIG. 5, when a drying process starts, the dryer 1 may control the heater 160 to be turned on according to embodiments.

Specifically, when the drying process starts, the heater 160 may be turned on until a temperature of air discharged to the drum 20 reaches a preset temperature, under the control of the controller 140. Afterwards, the heater 160 may be turned off, and the air discharged to the drum 20 may be heated by the heat pump 150.

A temperature inside of the drum 20 may be increased more rapidly by the heater 160 that assists the condenser 152, and a time taken for drying laundry may be reduced.

That is, referring to FIG. 5A, an output value of the first temperature sensor 110, i.e., the temperature of the air discharged to the drum 20, may be heated by the heater 160 until the temperature of the air discharged reaches the preset temperature in a section ⓪. Accordingly, the temperature of the air discharged may be increased more rapidly than when the air discharged is heated only by the heat pump 150.

When the heater 160 is turned on, the temperature of the air discharged to the drum 20 may be changed drastically, and a temperature of air flowing into the duct 50 from the drum 20 may also be affected.

Accordingly, when the heater 160 is turned on, a change in a difference value ($\Delta T$) between the temperature of the air discharged to the drum 20 and the temperature of the air flowing into the duct 50 from the drum 20 may occur.

Thus, in order to determine a valid difference value ($\Delta T$), the controller 140 may determine the difference value after the heater 160 is turned off. That is, the controller 140 may not determine the difference value ($\Delta T$) between the temperature of the air discharged to the drum 20 and the temperature of the air flowing into the duct 50 from the drum 20 in the section ① where the heater 160 is turned on.

After the heater 160 is turned off, the air discharged to the drum 20 may be heated by the heat pump 150. In this instance, the heat pump 150 may be operated at a constant RPM after the heater 160 is turned off, as shown in FIG. 5B (section ②).

Also, as shown in FIG. 5B, the heat pump 150 may change the RPM, so that the temperature of the air discharged to the drum 20 may be maintained at a target temperature, after a preset period of time or after the temperature of the air discharged to the drum 20 reaches a preset temperature (section ③).

That is, according to embodiments, the heat pump 150 may change the RPM based on at least one of the temperature of the air discharged to the drum 20 or the temperature of the air flowing into the duct 50 from the drum 20, under the control of the controller 140.

For instance, based on the temperature of the air discharged to the drum 20 decreasing, the heat pump 150 may increase the RPM, thereby may increase the temperature of the air discharged to the drum 20. Also, based on the temperature of the air discharged to the drum 20 increasing, the heat pump 150 may decrease the RPM, thereby may decrease the temperature of the air discharged to the drum 20. That is, the heat pump 150 changes the RPM under the control of the controller 140, thereby may maintain the temperature of the air discharged to the drum 20 at the target temperature.

In this instance, when the RPM of the compressor of the heat pump 150 is changed (section ③), the controller 140 may determine the difference value (ΔT) between the temperature of the air discharged to the drum 20 and the temperature of the air flowing into the duct 50 from the drum 20, after a preset period of time from a change time of the RPM.

The temperature of the air discharged to the drum 20 may be changed rapidly due to the change in RPM, and the temperature of the air flowing into the duct 50 from the drum 20 may also be affected.

Therefore, when the RPM of the heat pump 150 is changed (section ③), as shown in FIG. 5C illustrating the difference value (ΔT) with time, a change in difference value (ΔT) between the temperature of the air discharged to the drum 20 and the temperature of the air flowing into the duct 50 from the drum 20 may occur.

Accordingly, in order to determine a valid difference value (ΔT), the controller 140 may not determine the difference value for a predetermined period of time from a change time of the RPM of the heat pump 150, and may determine the difference value at preset time intervals after the predetermined period of time.

For example, when the compressor of the heat pump 150 changes the RPM from 3900 rpm to 2600 rpm at 1000 seconds from a start of the drying process, the controller 140 may determine the difference value (ΔT) from a point in time corresponding to 1200 seconds, i.e., after the preset period of time (e.g., 200 seconds) based on the start of the drying process.

In this instance, according to embodiments, when the RPM is changed again within the preset period of time after the compressor changes the RPM, the controller 140 may determine the difference value (ΔT) after the preset period of time from the last time the RPM was changed.

For example, when the compressor of the heat pump 150 changes the RPM from 3900 rpm to 2600 rpm at 1000 seconds from the start of the drying process, and changes the RPM from 2600 rpm to 2900 rpm at 1150 seconds based on the start of the drying process, the controller 140 may determine the difference value (ΔT) from a point in time corresponding to 1350 seconds, i.e., after the preset period of time (e.g., 200 seconds) from the last time the RPM was changed based on the start of the drying process.

In addition, according to embodiments, the controller 140 may not determine the difference value (ΔT) when the compressor of the heat pump 150 is turned off, and may determine the difference value (ΔT) after the compressor of the heat pump 150 is turned on, i.e., from a point in time when the preset period of time elapses after the RPM is changed.

As described above, according to certain embodiments, in order to determine a valid difference value (ΔT), the dryer 1 may consider whether the heat pump 150 or the heater 160 is operated, in determining whether drying is complete based on the difference value (ΔT) between the temperature of the air discharged to the drum 20 and the temperature of the air flowing into the duct 50 from the drum 20. That is, the dryer 1 determines whether drying is complete based on the valid difference value (ΔT), thereby may improve an accuracy.

Also, according to certain embodiments, the controller 140 may determine whether drying is complete based on an output value of the electrode sensor 130.

Specifically, based on the output value of the electrode sensor 130 not existing for a predetermined period of time, i.e., based on wet laundry not contacting the electrode sensor 130 for the predetermined period of time, the controller 140 may determine that drying is complete after a period of time (e.g., 0.6*T or 0.8*T) corresponding to a preset ratio (e.g., 0.6 or 0.8) to a period of time (T) of a drying process performed.

That is, the controller 140 may control the dryer 1 to additionally perform the drying process for the period of time (e.g., 0.6*T or 0.8*T) corresponding to the preset ratio (e.g., 0.6 or 0.8) to the period of time (T) of the drying process performed, from a point in time when it is determined that an electrode detection by the electrode sensor 130 is finished due to no contact with wet laundry. In this instance, the preset ratio may be determined as a value that decreases in proportion to the period of time (T) of the drying process performed.

In other words, the controller 140 may end the drying process after additionally performing the drying process for the period of time (e.g., 0.6*T or 0.8*T) corresponding to the preset ratio (e.g., 0.6 or 0.8) to the period of time (T) of the drying process performed, in addition to the period of time (T) of the drying process performed.

Through the above, the dryer 1 may additionally perform the drying process for the predetermined period of time without immediately ending the drying process, even when it is determined that an electrode detection by the electrode sensor 130 is finished due to no contact with laundry in a wet state. Accordingly, the controller 140 may prevent drying from incompletely finishing even when contact to the electrode sensor 130 is not smoothly made under minimal load due to a small amount of laundry in the drum 20.

In addition, according to certain embodiments, the controller 140 may determine that drying is complete after a preset period of time from a start of the drying process. In this instance, the preset period of time may set differently depending on a course of the drying process, and set by a user through the inputs 30*a* and 30*b*.

As described above, the dryer 1 may determine a drying end point based on the output of the electrode sensor 130 or the operation time of the drying process.

That is, according to embodiments, based on the determination that drying is complete based on one of the output of the electrode sensor 130, the operation time of the drying process, or the difference value (ΔT) between the temperature of the air discharged to the drum 20 and the temperature of the air flowing into the duct 50 from the drum 20, the dryer 1 may end the drying process.

Hereinafter, certain embodiments of a method of controlling the dryer 1 according to an aspect of the disclosure is described. The dryer 1 according to the above-described embodiments may be used in the method of controlling the dryer 1. Accordingly, the above description with reference to FIGS. 1 to 5 is equally applicable to the method of controlling the dryer 1.

Figure 6:
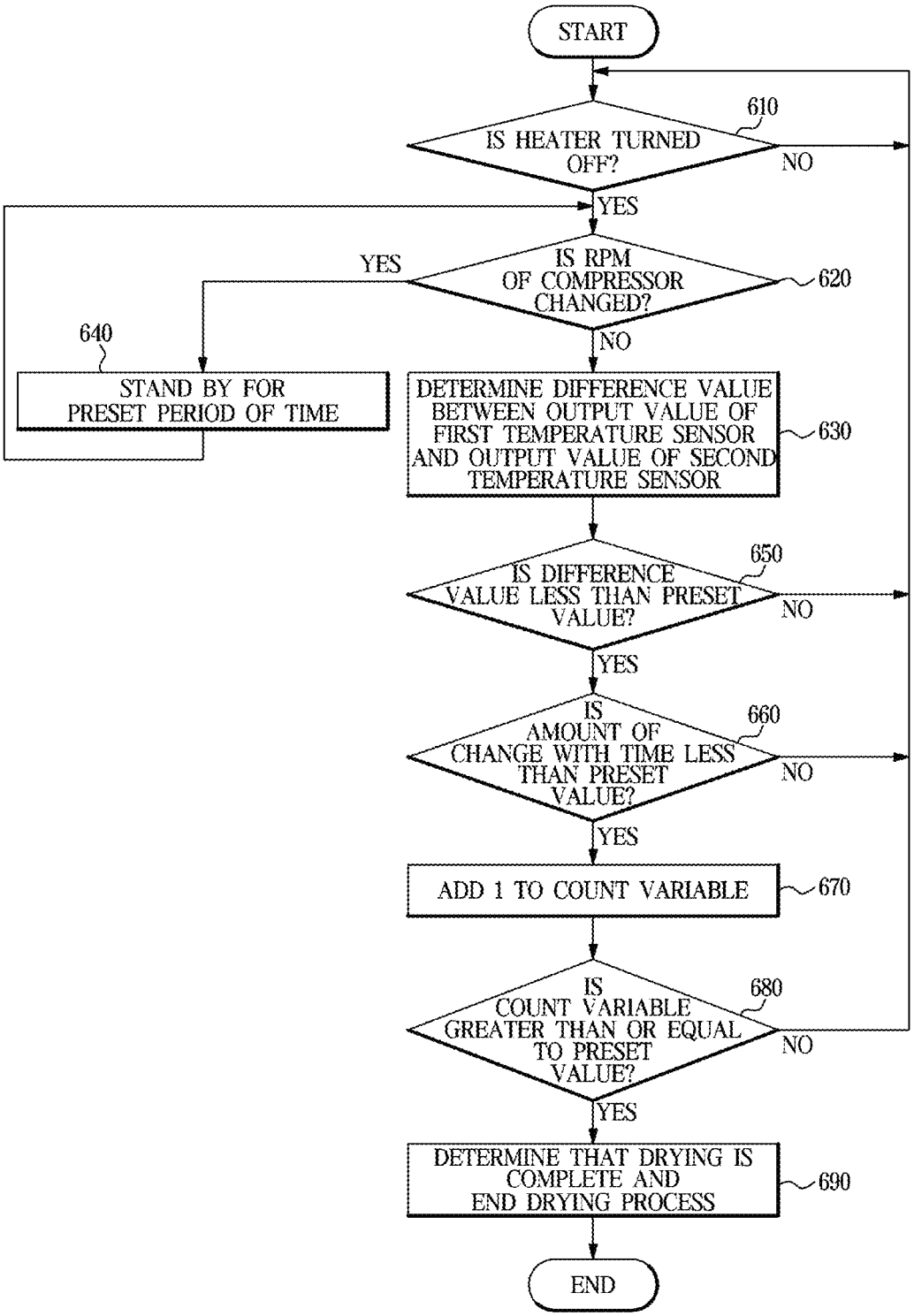
FIG. 6 illustrates a flowchart of determining completion of drying based on an output value of a first temperature sensor and an output value of a second temperature sensor in a method of controlling a dryer according to various embodiments of the disclosure.

FIG. 6 illustrates a flowchart of determining completion of drying based on an output value of the first temperature sensor 110 and an output value of the second temperature sensor 120 in a method of controlling the dryer 1 according to various embodiments of the disclosure.

Referring to FIG. 6, according to certain embodiments, when the heater 160 is turned off (Yes in operation 610) and a RPM of a compressor is not changed (No in operation 620), the dryer 1 may determine a difference value (ΔT)

between an output value of the first temperature sensor 110 and an output value of the second temperature sensor 120 (operation 630).

That is, in order to determine a valid difference value (ΔT), the dryer 1 may determine a difference value between a temperature of air discharged to the drum 20 or a temperature of air flowing in from the drum 20, only when the heater 160 is turned off and the RPM of the compressor is not changed.

In this instance, when the RPM of the compressor is changed (Yes in operation 620), the dryer 1 may stand by for a preset period of time (operation 640), and then determine whether the RPM of the compressor is changed.

In other words, in order to determine the valid difference value (ΔT), the dryer 1 may not determine the difference value (ΔT) for a predetermined period of time from a change time of the RPM of the heat pump 150, and may determine the difference value (ΔT) at preset time intervals after the predetermined period of time.

Based on determining that the difference value (ΔT) is less than a preset value (Yes in operation 650) and the amount of change with time is less than a preset amount (Yes in operation 660), the dryer 1 may add 1 to a count variable (operation 670).

In this instance, based on determining that the count variable is greater than or equal to a preset value (Yes in operation 680), the dryer 1 may determine that drying is complete and end a drying process (operation 690).

Specifically, the controller 140 of the dryer 1 may determine the difference value (ΔT) between a temperature ($T_1$) of the air discharged to the drum 20 or a temperature ($T_2$) of air flowing into the duct 50 from the drum 20 at preset time intervals. Every time the difference value (ΔT) is determined, the controller 140 may determine whether the difference value (ΔT) is less than the preset value. Based on the determination that the difference value (ΔT) is less than the preset value, the controller 140 may determine whether the amount of change ($|\Delta T-\Delta T_{min}|$) between the corresponding difference value (ΔT) and a minimum value ($\Delta T_{min}$) among previously determined difference values is less than a preset amount (e.g., 0.08). In this instance, based on determining that the amount of change between the corresponding difference value (ΔT) and the minimum value ($\Delta T_{min}$) among the previously determined difference values is less than the preset amount, the controller 140 may add 1 to a count variable.

In this instance, the preset number of times may be set differently depending on the preset value that is compared with the difference value (ΔT). Specifically, the preset number of times may be set higher as the preset value that is compared with the difference value (ΔT) increases.

As described above, according to certain embodiments, the dryer 1 may consider the number of times that the difference value (ΔT) is less than the preset value, and further consider whether the amount of change ($|\Delta T-\Delta T_{min}|$) between the corresponding difference value (ΔT) and the minimum value ($\Delta T_{min}$) among the previously determined difference values is less than the preset amount (e.g., 0.08), in order to determine whether the amount of change with time remains small, i.e., whether the difference value (ΔT) converges, for determining whether the difference value (ΔT) is maintained below the preset value.

Through the above, according to certain embodiments, the dryer 1 may prevent an erroneous determination that drying is complete even though drying is not complete, as the difference value (ΔT) temporarily decreases below the preset value due to external noise.

Also, according to certain embodiments, in determining the amount of change with time of the difference value (ΔT), the dryer 1 may compare the minimum value ($\Delta T_{min}$) among the previously determined difference values with a current difference value (ΔT) to determine the amount of change ($|\Delta T-\Delta T_{min}|$), and thus an influence of temperature increase due to external noise may be excluded.

That is, the dryer 1 may determine whether the difference value (ΔT) is converging based on the minimum value ($\Delta T_{min}$) by setting the minimum value ($\Delta T_{min}$) among the previously determined difference values as a comparison target of the amount of the change, and thus an accuracy of determining completion of drying may be improved.

Based on determining that the count variable is greater than or equal to a preset number of times (e.g., 10 or 30), the controller 140 may determine that the difference value (ΔT) is maintained below the preset value. Accordingly, the controller 140 may determine that drying is complete and end the drying process.

In this instance, based on determining that the difference value (ΔT) is not less than the preset value (No in operation 650), the amount of change with time is not less than the preset amount (No in operation 660), or the count variable is not greater than or equal to the preset value (No in operation 680), the dryer 1 may repeat the operations of determining the difference value (ΔT).

Figure 7:
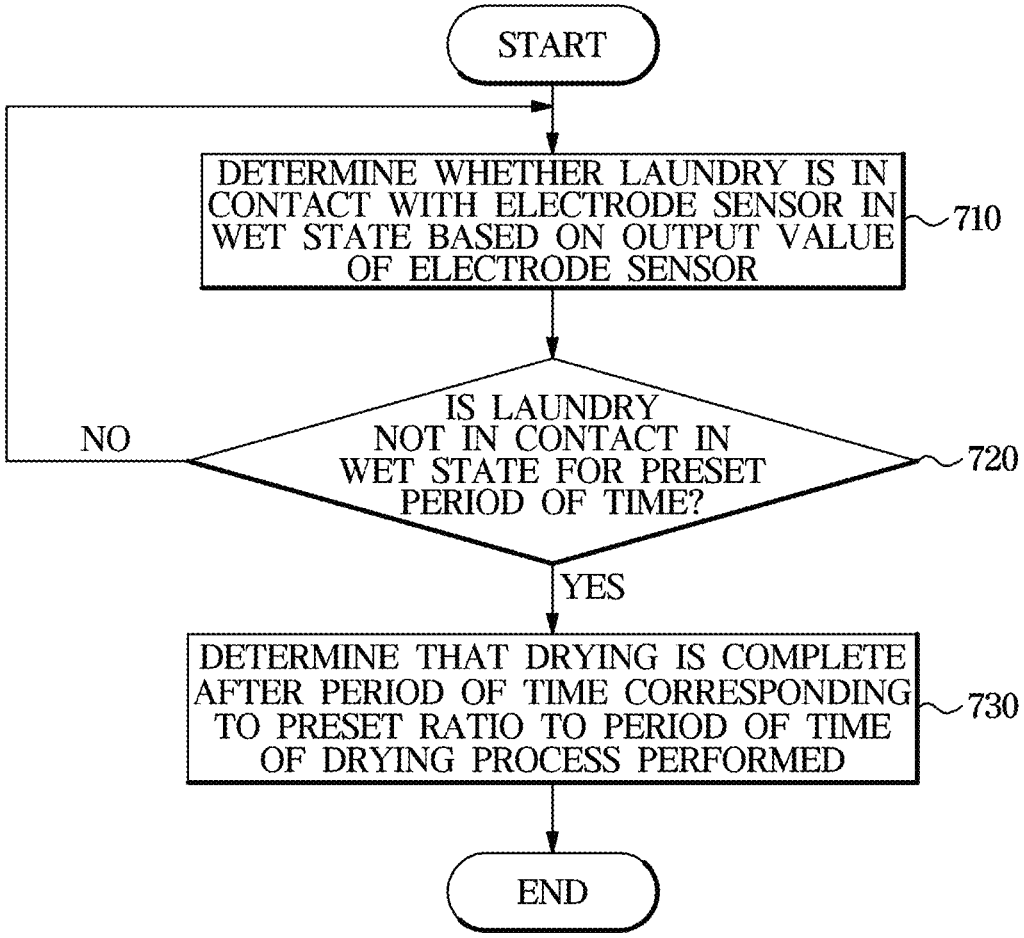
FIG. 7 illustrates a flowchart of determining completion of drying based on an output value of an electrode sensor in a method of controlling a dryer according to various embodiments of the disclosure.

FIG. 7 illustrates a flowchart of determining completion of drying based on an output value of the electrode sensor 130 in a method of controlling the dryer 1 according to various embodiments of the disclosure.

Referring to FIG. 7, according to certain embodiments, the dryer 1 may determine whether laundry is in contact with the electrode sensor 130 in a wet state based on an output value of the electrode sensor 130 (operation 710).

In this instance, based on determining that the laundry is not contacting the electrode sensor 130 in a wet state for a preset period of time (Yes in operation 720), the dryer 1 may determine that drying is complete after a period of time (e.g., 0.6*T or 0.8*T) corresponding to a preset ratio (e.g., 0.6 or 0.8) to a period of time (T) of a drying process performed (operation 730).

That is, the controller 140 of the dryer 1 may control the dryer 1 to additionally perform the drying process for the period of time (e.g., 0.6*T or 0.8*T) corresponding to the preset ratio (e.g., 0.6 or 0.8) to the period of time (T) of the drying process performed, from a point in time when it is determined that an electrode detection by the electrode sensor 130 is finished due to no contact with wet laundry. Afterwards, the controller 140 may determine that drying is complete and end the drying process. In this instance, the preset ratio may be determined as a value that decreases in proportion to the period of time (T) of the drying process performed.

In other words, the controller 140 may end the drying process after additionally performing the drying process for the period of time (e.g., 0.6*T or 0.8*T) corresponding to the preset ratio (e.g., 0.6 or 0.8) to the period of time (T) of the drying process performed, in addition to the period of time (T) of the drying process performed.

Through the above, the dryer 1 may additionally perform the drying process for a predetermined period of time without immediately ending the drying process, even when it is determined that an electrode detection by the electrode sensor 130 is finished due to no contact with wet laundry. Accordingly, the controller 140 may prevent drying from incompletely finishing even when contact to the electrode sensor 130 is not smoothly made under minimal load due to a small amount of laundry in the drum 20.

Meanwhile, the disclosed embodiments may be embodied in the form of recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which may be decoded by a computer are stored, for example, a Read Only Memory (ROM), a Random Access Memory (RAM), a magnetic tape, a magnetic disk, a flash memory, an optical data storage device, and the like.

Although embodiments of the disclosure have been described with reference to the accompanying drawings, a person having ordinary skilled in the art will appreciate that other specific modifications may be easily made without departing from the technical spirit or essential features of the disclosure. Therefore, the foregoing embodiments should be regarded as illustrative rather than limiting in all aspects.

DESCRIPTION OF REFERENCE NUMERALS

1; dryer
10; main body
20; drum
30*a*, 30*b*; input
40; fan
50; duct
110; first temperature sensor
120; second temperature sensor
130; electrode sensor
140; controller
150; heat pump
160; heater
170; storage

What is claimed is:

1. A dryer, comprising:
a drum;
a heat pump;
a duct configured to:
accommodate an evaporator and a condenser of the heat pump,
heat air flowing in from the drum, and
discharge the air to the drum;
a first temperature sensor configured to measure a temperature of the air discharged to the drum;
a second temperature sensor configured to measure a temperature of the air flowing in the duct from the drum; and
a controller configured to determine that drying is complete based on maintaining a difference value between the temperature of the air discharged and the temperature of the air flowing in below a preset value,
wherein the controller is further configured to determine that the difference value is maintained below the preset value based on determining that the difference value is less than the preset value and a number of times, which an amount of change with time is less than a preset amount, is greater than or equal to a preset number of times, and
wherein, when determining the difference value, the controller is further configured to determine an amount of change with time of the difference value as an amount of change between the difference value and a minimum value among previously determined difference values.

2. The dryer of claim 1, wherein the controller is further configured to:
repeatedly determine a difference value every first time period, and
for each first time period, determine a difference value between a mean value of the temperature of the air discharged during the first time period and a mean value of the temperature of the air flowing in during the first time period, as a difference value for a corresponding first time period.

3. The dryer of claim 1, wherein, when a revolution per minute (RPM) of a compressor of the heat pump is changed, the controller is further configured to determine whether drying is complete based on a difference value determined after a preset period of time based on a change time of the RPM.

4. The dryer of claim 1, further comprising:
a heater provided in the duct and configured to heat the air discharged.

5. The dryer of claim 4, wherein the controller is further configured to determine whether drying is complete based on a difference value determined after the heater is turned off.

6. A dryer, comprising:
a drum;
a heat pump;
a duct configured to:
accommodate an evaporator and a condenser of the heat pump,
heat air flowing in from the drum, and
discharge the air to the drum;
a first temperature sensor configured to measure a temperature of the air discharged to the drum;
a second temperature sensor configured to measure a temperature of the air flowing in the duct from the drum;
an electrode sensor configured to measure whether laundry accommodated in the drum is in contact in a wet state; and
a controller configured to determine that drying is complete based on maintaining a difference value between the temperature of the air discharged and the temperature of the air flowing in below a preset value,
wherein the controller is further configured to determine that the difference value is maintained below the preset value based on determining that the difference value is less than the preset value and a number of times, which an amount of change with time is less than a preset amount, is greater than or equal to a preset number of times,
wherein, when determining the difference value, the controller is further configured to determine an amount of change with time of the difference value as an amount of change between the difference value and a minimum value among previously determined difference values, and
wherein the controller is further configured to determine, based on a determination that the laundry is not in contact for a preset period of time based on an output value of the electrode sensor, drying is complete after a period of time corresponding to a preset ratio to a period of time of a drying process performed.

7. The dryer of claim 6, wherein the controller is further configured to determine that drying is complete after a preset period of time has elapsed from a start of a drying process.

8. A method of controlling a dryer comprising a drum, a heat pump, a duct configured to accommodate an evaporator and a condenser of the heat pump, and heat air flowing in from the drum to discharge the air to the drum, a first temperature sensor configured to measure a temperature of the air discharged to the drum, and a second temperature sensor configured to measure a temperature of the air flowing in the duct from the drum, the method comprising:

determining that drying is complete based on maintaining a difference value between the temperature of the air discharged and the temperature of the air flowing in below a preset value, wherein the determining that drying is complete comprises determining that the difference value is maintained below the preset value based on determining that the difference value is less than the preset value and a number of times, which an amount of change with time is less than a preset amount, is greater than or equal to a preset number of times, and wherein, when determining the difference value, the determining that drying is complete comprises determining an amount of change with time of the difference value as an amount of change between the difference value and a minimum value among previously determined difference values.

9. The method of claim 8, further comprising:

repeatedly determining the difference value every first time period, wherein the determining that drying is complete further comprises, for each first time period, determining a difference value between a mean value of the temperature of the air discharged during the first time period and a mean value of the temperature of the air flowing in during the first time period, as a difference value for a corresponding first time period.

10. The method of claim 8, further comprising:

when a revolution per minute (RPM) of a compressor of the heat pump is changed, determining whether drying is complete based on a difference value determined after a preset period of time based on a change time of the RPM.

* * * * *